US010400495B1

(12) United States Patent
Yu

(10) Patent No.: US 10,400,495 B1
(45) Date of Patent: Sep. 3, 2019

(54) AUTOMATIC RETURN DEVICE FOR GLASS DOOR

(71) Applicant: SUN-Q DOOR CONTROLS LIMITED, Yuanlin, Changhua County (TW)

(72) Inventor: Shun-Hsien Yu, Yuanlin (TW)

(73) Assignee: SUN-Q DOOR CONTROLS LIMITED, Yuanlin, Changhua County (TW)

( * ) Notice: Subject to any disclaimer, the term of this patent is extended or adjusted under 35 U.S.C. 154(b) by 0 days.

(21) Appl. No.: 16/104,625

(22) Filed: Aug. 17, 2018

(30) Foreign Application Priority Data

Jul. 10, 2018 (TW) ..... 107123914 A

(51) Int. Cl.

| | |
|---|---|
| ***E05F 3/20*** | (2006.01) |
| ***E05D 5/02*** | (2006.01) |
| ***E05F 3/10*** | (2006.01) |
| ***E05F 3/22*** | (2006.01) |
| ***E05F 1/12*** | (2006.01) |

(52) U.S. Cl.
CPC ..... *E05F 3/20* (2013.01); *E05D 5/0246* (2013.01); *E05F 1/1253* (2013.01); *E05F 3/10* (2013.01); *E05F 3/22* (2013.01); *E05Y 2900/132* (2013.01); *Y10T 16/534* (2015.01)

(58) Field of Classification Search
CPC ..... E05F 3/20; E05F 3/10; E05F 3/22; E05F 3/104; E05F 1/1253; E05D 5/0246; E05Y 2900/132; Y10T 16/534; Y10T 16/276; Y10T 16/2766; Y10T 16/2769; Y10T 16/2771; Y10T 16/2788; Y10T 16/2793; Y10T 16/2796; Y10T 16/304; Y10T 16/625; A47K 3/36; E06B 2003/26398
USPC ..... 16/252, 51–54, 58–60, 50, 85, 72; 49/388; 4/607, 557
See application file for complete search history.

(56) References Cited

U.S. PATENT DOCUMENTS

| | | | | |
|---|---|---|---|---|
| 6,154,924 | A * | 12/2000 | Woo | E05F 3/14 16/51 |
| 7,900,319 | B2 * | 3/2011 | Bacchetti | E05D 5/0246 16/252 |
| 8,443,487 | B2 * | 5/2013 | Bacchetti | E05F 3/104 16/51 |
| 8,528,169 | B1 * | 9/2013 | Yu | E05D 7/043 16/238 |
| 8,539,643 | B2 * | 9/2013 | Hung | E05F 3/12 16/252 |

(Continued)

*Primary Examiner* — William L Miller
(74) *Attorney, Agent, or Firm* — Muncy, Geissler, Olds & Lowe, P.C.

(57) ABSTRACT

An automatic return device for glass doors includes a hydraulic hinge assembly having a first base, a piston unit, a first drive axle and a first grip unit and a leaf positioning assembly having a second base, a slide seat unit, a second drive axle, and second grip unit. The first and second bases are connected to a doorframe. The piston unit and first drive axle are set in the first base. The first drive axle interacts with the piston unit to generate oil pressure. The first and second drive axles are connected to the first and second grip units that grip a glass door. The slide seat unit and the second drive axle are set in the second base. When the second drive axle pivots, the slide seat unit positions the second drive axle at a predetermined pivotal angle.

10 Claims, 9 Drawing Sheets

(56) References Cited

U.S. PATENT DOCUMENTS

| | | | | |
|---|---|---|---|---|
| 8,578,556 | B1 * | 11/2013 | Yu | E05F 3/227 16/240 |
| 8,720,005 | B2 * | 5/2014 | Cheng | E05D 5/0246 16/252 |
| 8,863,356 | B2 * | 10/2014 | Bacchetti | E05F 3/104 16/54 |
| 2010/0199459 | A1 * | 8/2010 | Bacchetti | E05D 5/0246 16/54 |
| 2012/0216370 | A1 * | 8/2012 | Chow | E05D 5/0246 16/54 |
| 2012/0279015 | A1 * | 11/2012 | Hung | E05F 3/12 16/297 |
| 2012/0311817 | A1 * | 12/2012 | Bacchetti | E05F 3/104 16/51 |
| 2013/0160238 | A1 * | 6/2013 | Cheng | E05D 5/0246 16/54 |
| 2014/0068893 | A1 * | 3/2014 | Hung | E05F 3/20 16/52 |
| 2015/0121653 | A1 * | 5/2015 | Bacchetti | E05F 3/104 16/54 |

* cited by examiner

AUTOMATIC RETURN DEVICE FOR GLASS DOOR

BACKGROUND OF THE INVENTION

1. Technical Field

The present invention relates to automatic return machinery for glass doors, and more particularly to an automatic return device combining hydraulically hinging and positioning functions, which controls opening and closing velocity of a glass door and positions the glass door at a predetermined pivotal angle.

2. Description of Related Art

A conventional glass door typically has its door plank pivotally connected to a doorframe through hydraulic hinges for easy opening and closing. Such a hydraulic hinge usually comprises a fixing plate, a base, a piston unit, a drive axle, and a grip unit. The fixing plate is fixed to the doorframe, and the base is fixedly connected to the fixing plate. The piston unit is installed in the base in a transversely movable manner and abuts against the base through a spring. The drive axle vertically passes through the base and has its two ends jutting out of the base. The piston unit abuts against the drive axle. The grip unit grips the glass door and it connected to the two ends of the drive axle exposed outside the base. Thereby, when the glass door is closed, the glass door drives the grip unit and the drive axle to pivot, thereby making the drive axle guide the piston unit to provide resistance against the door-opening and/or door-closing force. However, when the opened glass door makes the drive axle pivot for a predetermined angle, the spring abutting against the piston unit pushes and thereby returns the piston unit. Since there is no buffer mechanism, the returning force of the glass door acts fully on the doorframe, and this may cause impact-induced damages to the affected door components after long-term use.

Moreover, the conventional hydraulic hinge has no positioning function, so the glass door using the same will immediately return to its closed position after opened. This makes the conventional hydraulic hinge less suitable for the applications where the door needs to be kept open for ventilation or other reasons.

Hence, there is a need for an improved hydraulic hinge for glass doors.

BRIEF SUMMARY OF THE INVENTION

The primary objective of the present invention is to provide an automatic return device for glass doors, which advantageously controls opening and closing velocity of a glass door and positions the glass door at a predetermined pivotal angle.

The automatic return device comprises a hydraulic hinge assembly and a leaf positioning assembly. The hydraulic hinge assembly comprises a first fixing plate; a first base, being fixedly connected to the first fixing plate and defining therein an oil storage area extending transversely and a first axial hole vertically communicated with the oil storage area; a piston unit, having a piston seat that is received in the oil storage area in a transversely movable manner, wherein the piston seat has a guide groove that extends vertically and has two racks flanking the guide groove; a first drive axle, having a first shaft and a guide wheel attached to the first shaft, the first shaft being rotatably received in the first axial hole and have two ends thereof exposed outside the first axial hole, the guide wheel being located in the guide groove of the piston seat, the guide wheel having a tooth portion for selectively engaging with the two racks, so that the piston seat is guided by the guide wheel and presses oil in the oil storage area; a first grip unit, gripping a glass door and being connected to two ends of the first shaft so as to pivot with the first shaft synchronously. The leaf positioning assembly comprises a second fixing plate; a second base, being fixedly connected to the second fixing plate and defining therein a transversely extending receiving area and a second axial hole vertically communicated with the receiving area; a slide seat unit, comprises a slide seat, a first ball, and a second spring, wherein the slide seat is set in the receiving area in a transversely movable manner, and the second spring is set in the receiving area to abut against one end of the slide seat whose opposite end is provided with a depression for receiving the first ball; a second drive axle, having a second shaft and a cam attached to the second shaft, the second shaft being rotatably received in the second axial hole and having two ends thereof exposed outside the second axial hole, the cam having a front end and two laterals connected to the front end, each of the front end and the two lateral ends having a pit for the first ball to selectively lean against one of the pits; and a second grip unit, gripping the glass door and being connected to two ends of the second shaft so as to pivot with the second shaft synchronously.

Preferably, the piston unit further comprises a first spring, and the piston seat divides the oil storage area into a first oil storage area and a second oil storage area, so that the first spring is set in the first oil storage area and abuts against the piston seat, in which the first base contains an oil passage, a valve hole, and a regulating valve, the oil passage communicating the first oil storage area with the second oil storage area, and the valve hole being communicated with the oil passage and receiving the regulating valve.

Preferably, the valve hole extends downward from a top of the first base and communicates with the oil passage.

Preferably, a first fixed bar passes transversely through the first grip unit and one end of the first shaft, and a second fixed bar passes transversely through the second grip unit and one end of the second shaft.

Preferably, the piston seat defines therein a routing channel that are communicated with the second oil storage area and the guide groove.

Preferably, one of the racks has a through hole, and the routing channel is communicated with the guide groove through the through hole.

Preferably, the routing channel comprises a large-diameter segment and a small-diameter segment communicated with each other, the small-diameter segment being communicated with the guide groove, the large-diameter segment being communicated with the second oil storage area, a second ball being set in the large-diameter segment, and the second ball having an outer diameter that is greater than the a bore of the small-diameter segment.

Preferably, the depression provided at the opposite end of the slide seat is hemispherical.

Preferably, the slide seat comprises a disk body and a column, the disk body having a front end surface, a rear end surface, and a circular lateral connected between the front end surface and the rear end surface, the circular lateral of the disk body abutting against an inner wall of the receiving area, the rear end surface of the disk body having the depression, the column one end being fixedly connected to the front end surface of the disk body, and the second spring abutting against the front end surface of the disk body and being mounted around the column.

Preferably, each of the pits extends vertically at the front end or one of the two lateral ends of the cam.

Thereby, when the glass door is opened, the first grip unit, the first shaft, the second grip unit, and the second shaft are driven to pivot synchronously. The tooth portion of the guide wheel engages with one of the racks, thereby guiding the piston seat to press the oil in the oil storage area and generating resistance against the door-opening force. When the glass door is opened to a predetermined position, the first ball of the slide seat engages with the pit at one of the lateral ends of the cam, so that the glass door is stopped at the predetermined position. When the glass door is pushed and leaves the predetermined position so that the first ball leaves the pit at the lateral end of the cam, the first spring pushes the piston seat and returns the guide wheel to its original position. This, working with the oil passage, the valve hole, and the regulating valve, controls the door-closing velocity and return the glass door to its closed state.

Hence, the disclosed automatic return device for glass doors can advantageously control opening and closing velocity of a glass door and position the glass door at a predetermined pivotal angle.

The following preferred embodiments when read with the accompanying drawings are made to clearly exhibit the above-mentioned and other technical contents, features and effects of the present invention. Through the exposition by means of the specific embodiments, people would further understand the technical means and effects the present invention adopts to achieve the above-indicated objectives. However, the accompanying drawings are intended for reference and illustration, but not to limit the present invention.

DETAILED DESCRIPTION OF THE INVENTION

Figure 1:
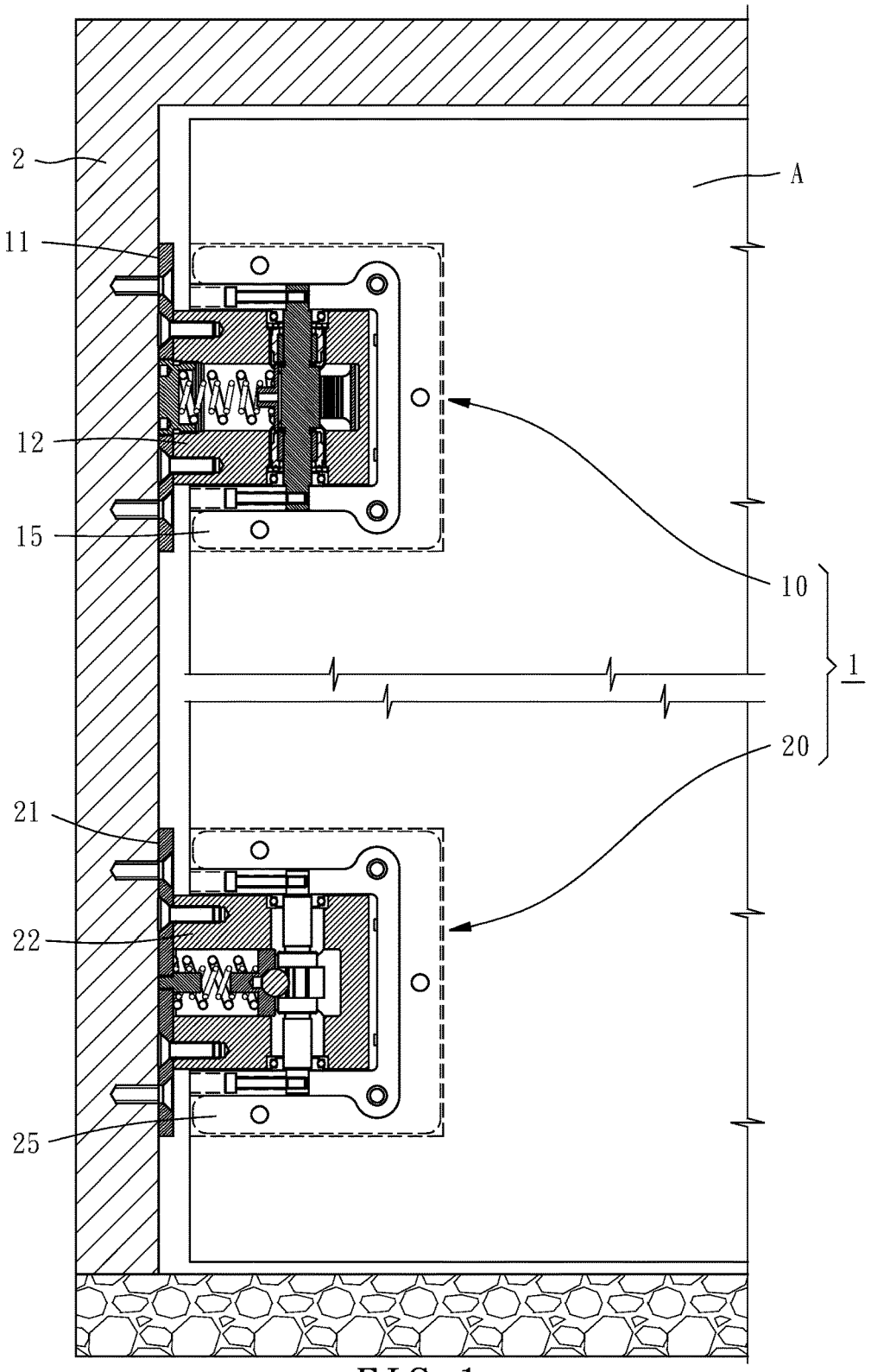
FIG. 1 is an applied view of one embodiment of the present invention, showing its hydraulic hinge assembly and leaf positioning assembly installed on a glass door.
Figure 2:
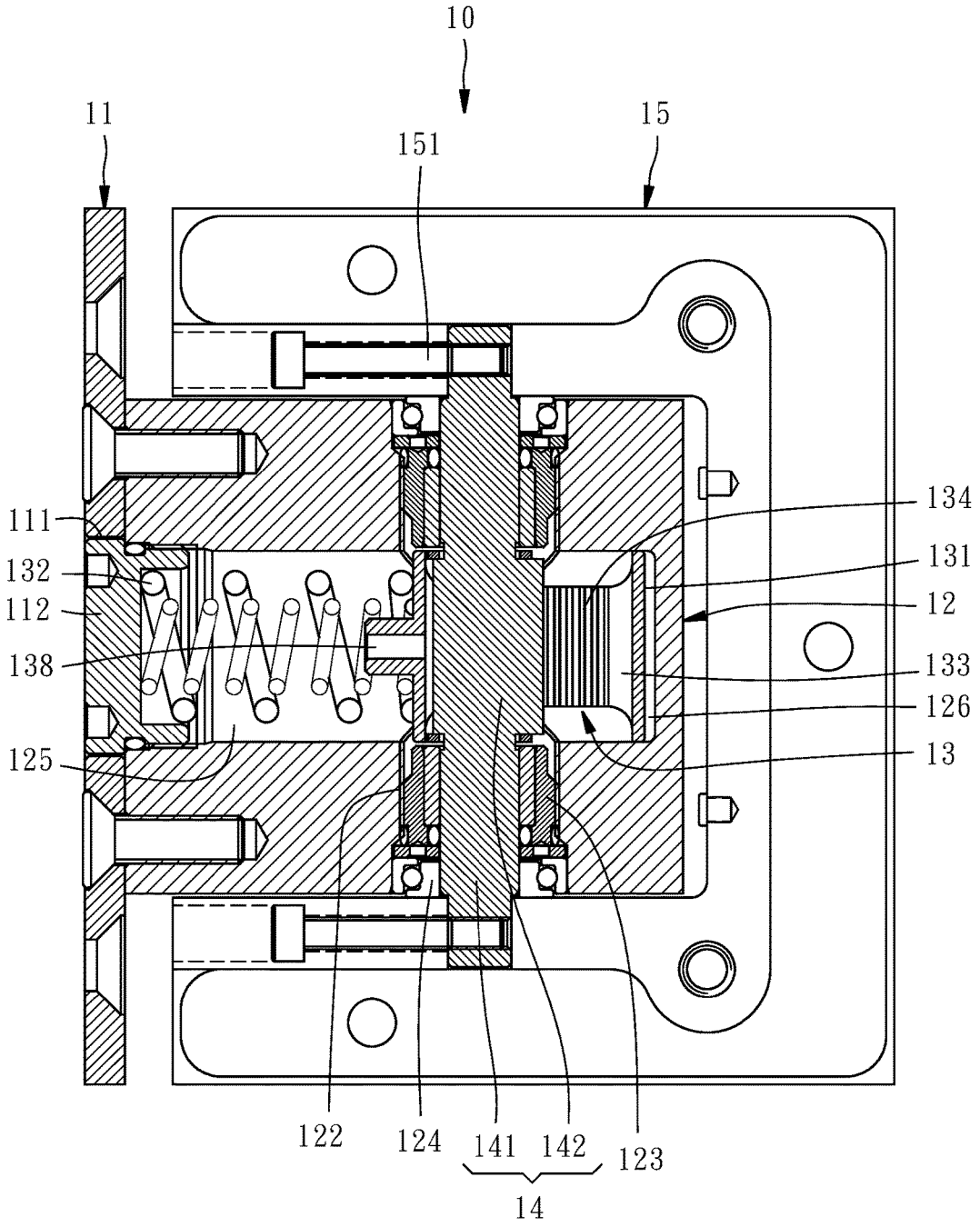
FIG. 2 is a vertically cross-sectional view of the hydraulic hinge assembly.
Figure 3:
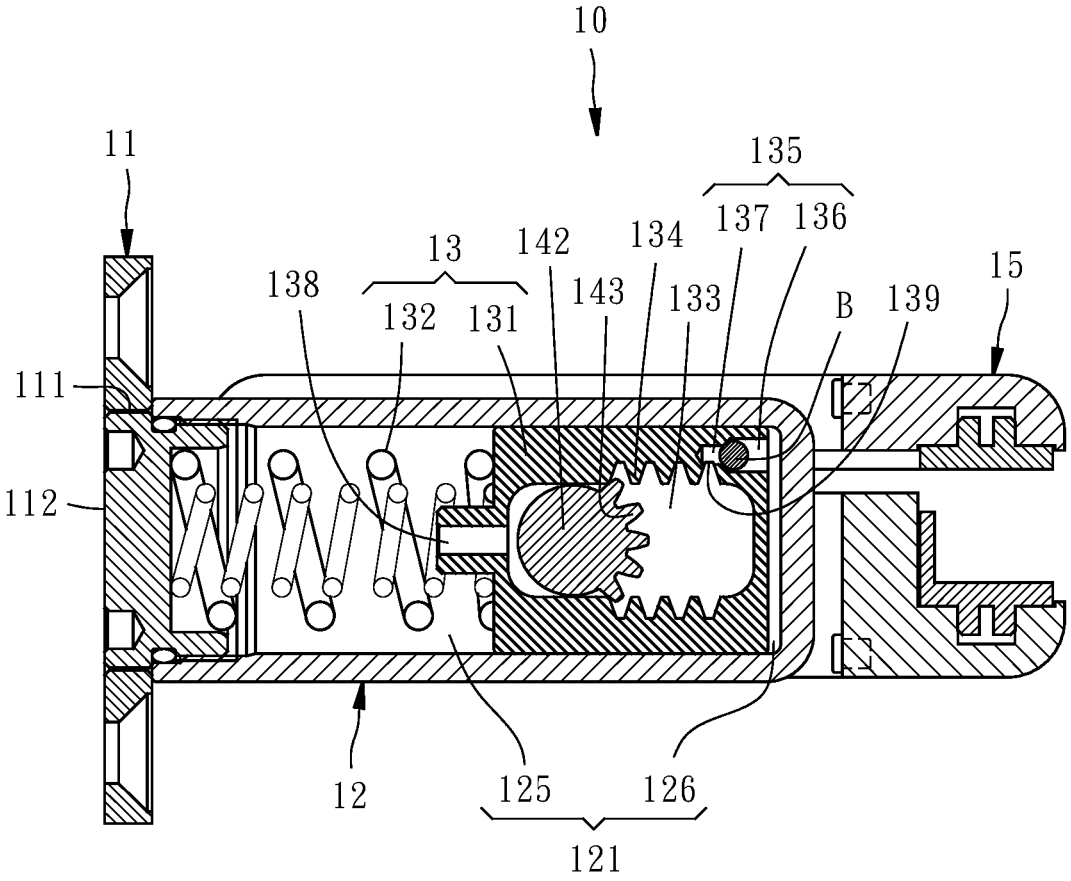
FIG. 3 is a transversely cross-sectional view of the hydraulic hinge assembly.
Figure 4:
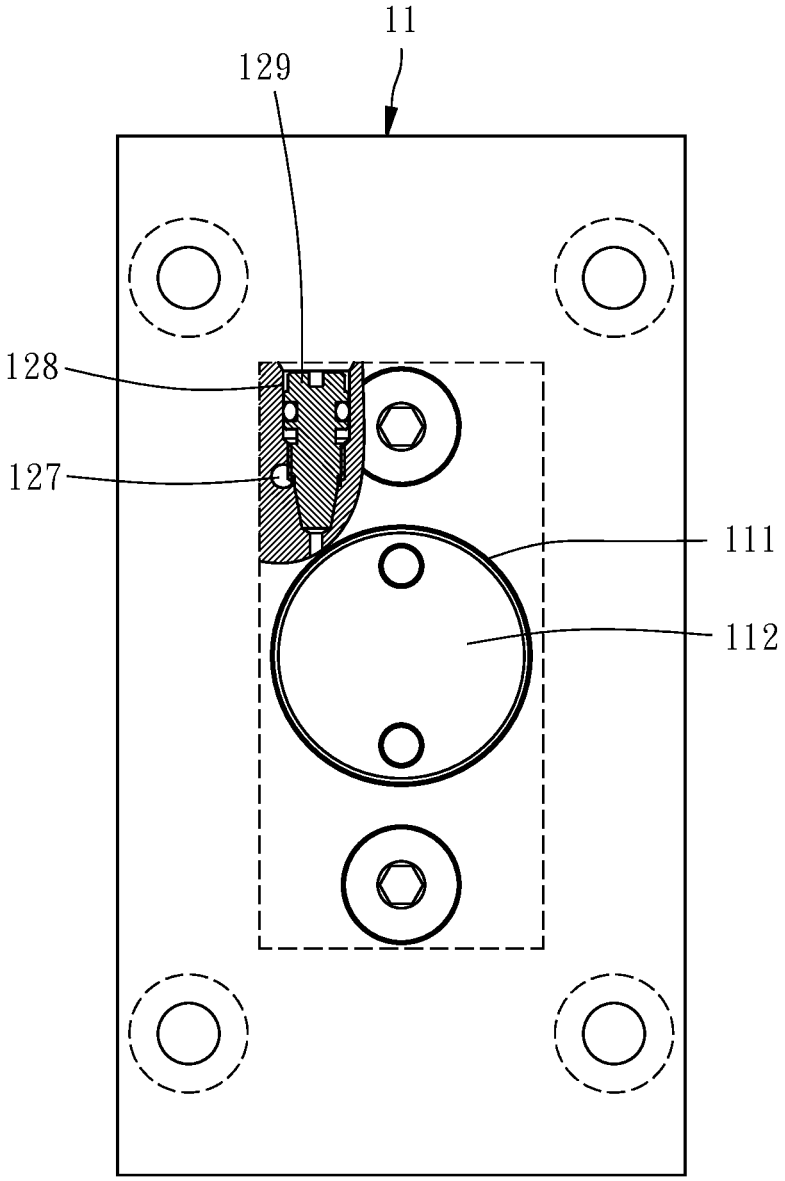
FIG. 4 is a left-side lateral view of a first fixing plate and a first base.
Figure 5:
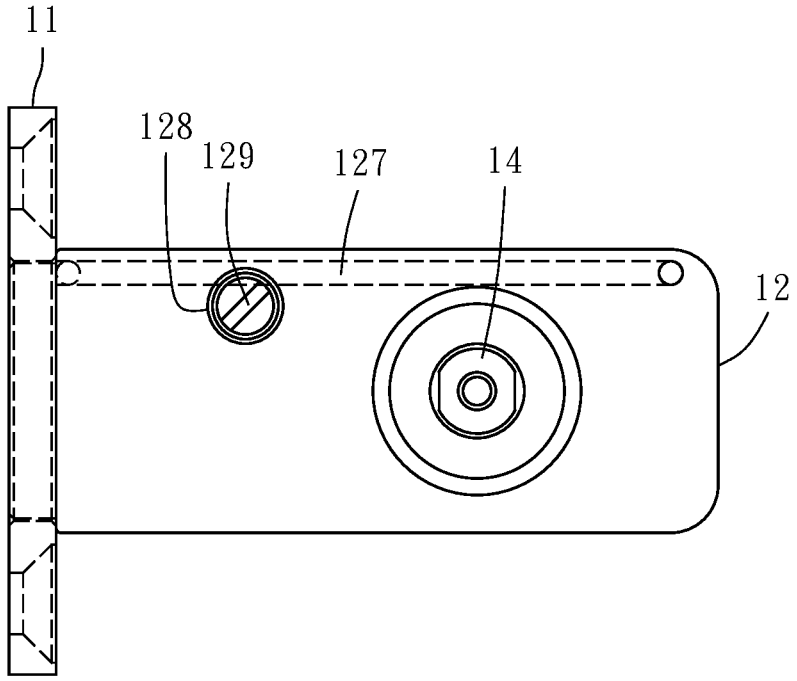
FIG. 5 is a top view of the first fixing plate and the first base.

Referring to FIG. 1, according to one embodiment of the present invention, an automatic return device 1 for glass doors comprises a hydraulic hinge assembly 10 and a leaf positioning assembly 20. The hydraulic hinge assembly 10 and leaf positioning assembly 20 are installed at the same side and near the upper and lower edges of a glass door A, respectively. In the present embodiment, the hydraulic hinge assembly 10 is installed above the leaf positioning assembly 20. In other embodiments, the hydraulic hinge assembly 10 and the leaf positioning assembly 20 may be positionally interchanged, namely having the hydraulic hinge assembly 10 installed higher than the leaf positioning assembly 20.

Please refer to FIGS. 2-5. The hydraulic hinge assembly 10 comprises a first fixing plate 11, a first base 12, a piston unit 13, a first drive axle 14 and a first grip unit 15.

In the present embodiment, the first fixing plate 11 is fixedly connected to the doorframe 2. In other embodiments, it may be directly fixed to a wall. The first base 12 is fixedly connected to the first fixing plate 11. The first base 12 contains therein an oil storage area 121 transversely extending and a first axial hole 122 vertically communicated with the oil storage area 121. The first fixing plate 11 is provided with a through hole 111 for communicating with the oil storage area 121. The through hole 111 has a seal cap 112 for sealing the oil storage area 121. The oil storage area 121 stores oil. The first axial hole 122 at its upper and lower ends coaxially installed with both a needle bearing 123 and a ball bearing 124. In other embodiments, there may be only a needle bearing 123 or a ball bearing 124 installed at the upper and lower ends of the first axial hole 122.

The piston unit 13 has a piston seat 131 and a first spring 132. The piston seat 131 is installed in the oil storage area 121 in a transversely movable manner, and divides the oil storage area 121 into a first oil storage area 125 and a second oil storage area 126. The first spring 132 is located in the first oil storage area 125 with its two ends abutting against the piston seat 131 and the seal cap 112, respectively. Therein, the first base 12 has therein an oil passage 127, a valve hole 128, and a regulating valve 129. The oil passage 127 transversely extends inside the first base 12 and communicates the first oil storage area 125 with the second oil storage area 126. The valve hole 128 extends downward from the top of the first base 12 and communicates with the oil passage 127. The regulating valve 129 is installed in the valve hole 128 for controlling oil flow passing through the valve hole 128. Therein, the piston seat 131 defines therein a vertically extending guide groove 133. The piston seat 131 has two racks 134 flanking the guide groove 133. In addition, the piston seat 131 defines therein a routing channel 135 and a routing mouth 138. The routing channel 135 communicates the second oil storage area 126 with the guide groove 133. More particularly, one of the racks 134 is formed with a through hole 139. The routing channel 135 is communicates with the guide groove 133 through the through hole 139. Even more particularly, the routing channel 135 comprises a large-diameter segment 136 and a small-diameter segment 137 that are communicated with each other. The small-diameter segment 137 is communicated with the guide groove 133 through the through hole 139. The large-diameter segment 136 is communicated with the second oil storage area 126. A second ball B is set in the large-diameter segment 136 and has an outer diameter greater than the bore of the small-diameter segment 137. The routing mouth 138 communicates the first oil storage area 125 with the guide groove 133.

The first drive axle 14 has a first shaft 141 and a guide wheel 142 attached to the first shaft 141. The first shaft 141 is rotatably received in the first axial hole 122. The first shaft 141 extends vertically and has its two ends inserted into the needle bearings 123 and the ball bearings 124 at the upper and lower ends of the first axial hole 122, respectively, so that the two ends of the first shaft 141 jut out of the first axial hole 122. The needle bearings 123 and the ball bearings 124 work as seals for preventing oil from leaking out from the first axial hole 122. The guide wheel 142 is so mounted around the middle part of the first shaft 141 that it is located in the guide groove 133 of the piston seat 131. In the present embodiment, the first shaft 141 and the guide wheel 142 are formed integratedly. Therein, the guide wheel 142 has a tooth portion 143. When receiving an external force, the first shaft 141 rotates and drives the guide wheel 142 to rotate so that the tooth portion 143 selectively engages with one of the racks 134. Since the first shaft 141 and the guide wheel 142 rotate without displacement, the guide wheel 142 makes the piston seat 131 compress the oil in the oil storage area 121. More particularly, the guide wheel 142 guides the piston seat 131 to press the oil in the first oil storage area 125 so that oil is forced to flow from the first oil storage area 125 to the second oil storage area 126 through the routing mouth 138, the guide groove 133, and the routing channel 135. When the external force is removed, the first spring 132 pushes the piston seat 131 to its original position. At this time, the piston seat 131 compresses the oil in the second oil storage area 126 to make the oil flow back to the first oil storage area 125 from the second oil storage area 126 through the oil passage 127 and the valve hole 128, until the piston seat 131 returns to its original position.

The first grip unit 15 is connected to the two ends of the first shaft 141 exposed outside the first axial hole 122 so that it pivots with the first shaft 141. The first grip unit 15 grips the glass door A. When the glass door A drives the first grip unit 15 to pivot, the first grip unit 15 synchronously drives the first shaft 141 to pivot. More particularly, a first fixed bar 151 transversely passes through the first grip unit 15 and one end of the first shaft 141. Thereby, when the first grip unit 15 pivots, the first grip unit 15 synchronously drives the first shaft 141 to pivot.

Figure 6:
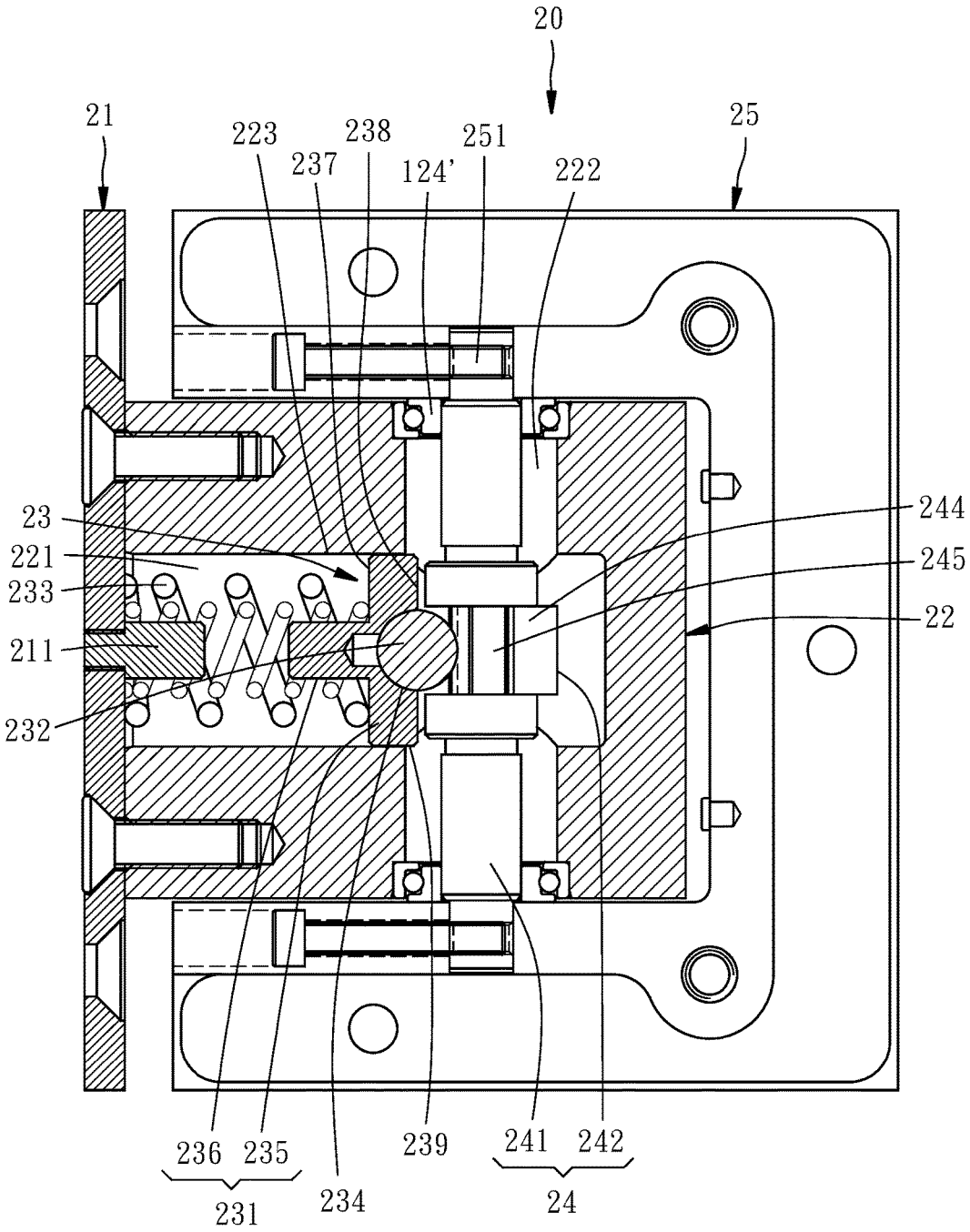
FIG. 6 is a vertically cross-sectional view of the leaf positioning assembly.
Figure 7:
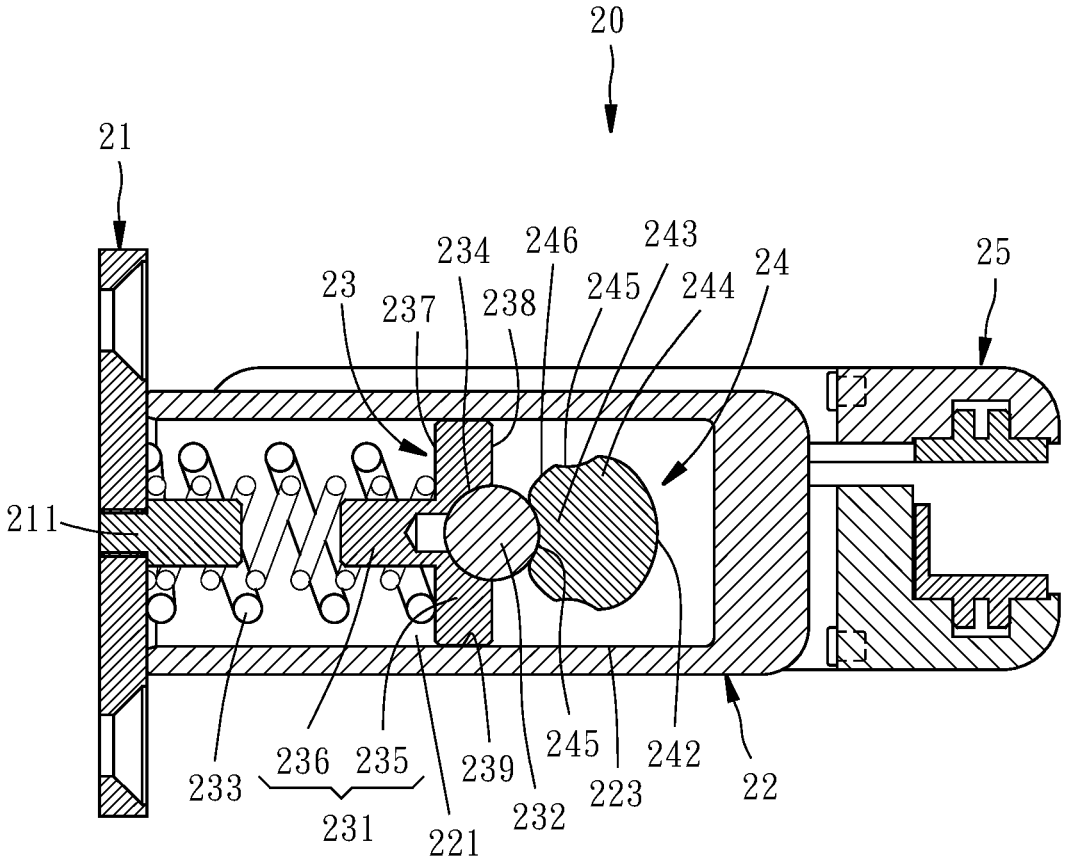
FIG. 7 is a transversely cross-sectional view of the leaf positioning assembly.

Referring to FIGS. 6-7, the leaf positioning assembly 20 comprises a second fixing plate 21, a second base 22, a slide seat unit 23, a second drive axle 24, and a second grip unit 25.

In the present embodiment, the second fixing plate 21 is fixedly connected to the doorframe 2. In other embodiments, it may be alternatively fixed to the wall. The second base 22 is fixedly connected to second fixing plate 21. The second base 22 defines therein a receiving area 221 transversely extending and a second axial hole 222 vertically communicated with the receiving area 221. The second fixing plate 21 has a post 211 extending transversely toward the receiving area 221. The second axial hole 222 has its two ends each provided with a ball bearing 124'. The two ball bearings 124' are installed coaxially. In other embodiments, each of the ball bearings 124' may be replaced by a needle bearing.

The slide seat unit 23 comprises a slide seat 231, a first ball 232, and a second spring 233. The slide seat 231 is installed in the receiving area 221 in a transversely movable manner. The second spring 233 is set in the receiving area 221 and abuts against one end of the slide seat 231. The slide seat 231 has its opposite end provided with a depression 234 for receiving first ball 232. More particularly, the slide seat 231 comprises a disk body 235 and a column 236. The disk body 235 has a front end surface 237, a rear end surface 238, and a circular lateral 239 connected between the front end surface 237 and the rear end surface 238. The circular lateral 239 of the disk body 235 abuts against the inner wall 223 of the receiving area 221. The rear end surface 238 of the disk body 235 is provided with a depression 234. The column 236 has its one end fixedly connected to the front end surface 237 of the disk body 235. The second spring 233 has its one end abutting against the front end surface 237 of the disk body 235 and is mounted around the column 236. The opposite end of the second spring 233 abuts against the second fixing plate 21 is mounted around the post 211. In the present embodiment, the first ball 232 is a steel ball and the depression 234 is hemispherical to fittingly receive the first ball 232.

The second drive axle 24 comprises a second shaft 241 and a cam 242 attached to the second shaft 241. The second shaft 241 is rotatably received in the second axial hole 222. The second shaft 241 extends vertically with two ends thereof passing through the ball bearings 124' at the upper and lower ends of the second axial hole 222, respectively. The second shaft 241 has its two ends exposed outside the second axial hole 222. In the present embodiment, the cam 242 is integratedly formed at the middle part of the second shaft 241 and leans against the first ball 232. The cam 242 has a front end 243 and two lateral ends 244 connected to the front end 243. The front end 243 and two lateral ends 244 each have a pit 245, so that the first ball 232 can selectively lean against one of the pits 245. More particularly, when the second shaft 241 receives an external force and drives the cam 242 to rotate, the second spring 233 pushes the first ball 232 against one of the pits 245. When the external force is removed, the first ball 232 stays in the pit 245 and stop the second shaft 241 and the cam 242 from rotation, so as to make the second shaft 241 and the cam 242 positioned. It is to be noted that, the pits 245 extend vertically at the front end 243 and the two lateral ends 244 of the cam 242, respectively, and the lateral end 244 and the front end 243 of the cam 242 are connected by convex surfaces 246, so that when the first ball 232 leaves the pit 245 and leans against the convex surface 246, the second shaft 241 can rotate smoothly.

The second grip unit 25 is connected to the two ends of the second shaft 241 exposed outside the second axial hole 222 so that it pivots with the second shaft 241. The second grip unit 25 grips the glass door A. Thus, when the glass door A drives the second grip unit 25 to pivot, the second grip unit 25 synchronously drives the second shaft 241 to pivot. More particularly, a second fixed bar 251 transversely passes through the second grip unit 25 and one end of the second shaft 241. Thereby, when the second grip unit 25 pivots, the second grip unit 25 drives the second shaft 241 to pivot.

Figure 8A:
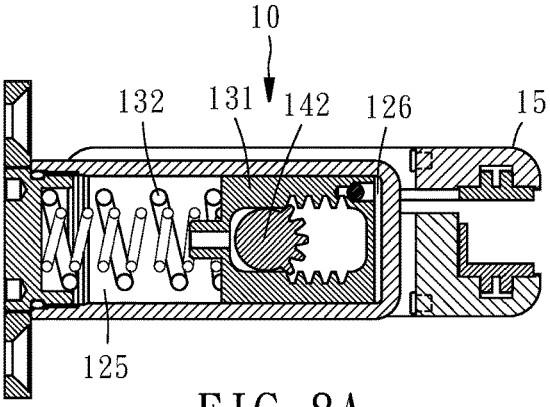
FIGS. 8A-8C illustrate operation of the hydraulic hinge assembly.
Figure 9A:
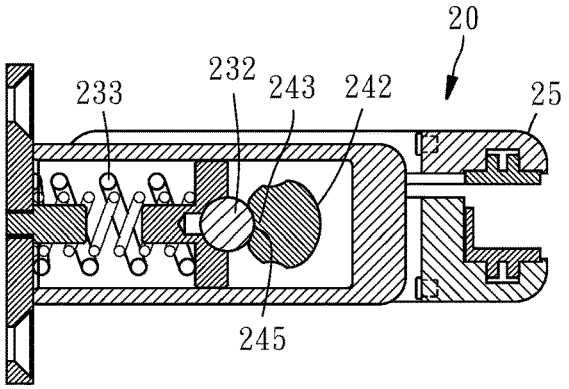
FIG. 9A-9C illustrate operation of the leaf positioning assembly.

FIGS. 8A and 9A show the hydraulic hinge assembly 10 and the leaf positioning assembly 20 when the glass door A is in its closed state. In the hydraulic hinge assembly 10, the first spring 132 pushes the piston seat 131 toward one end of the oil storage area 121, so that the second oil storage area 126 is at this time has its least volume. In the leaf positioning assembly 20, the first ball 232 is pushed by the second spring 233 and engages with the pit 245 at the front end 243 of the cam 242.

Figure 8B:
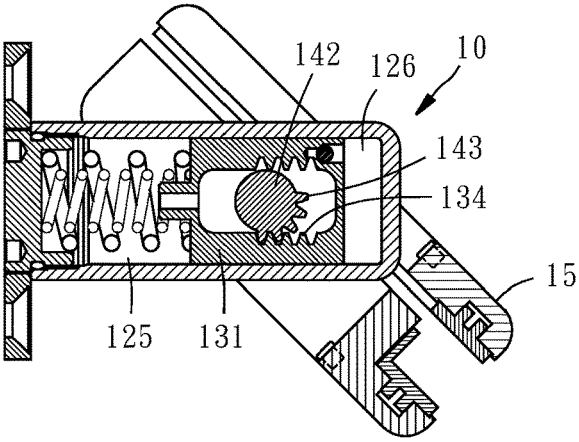
Figure 9B:
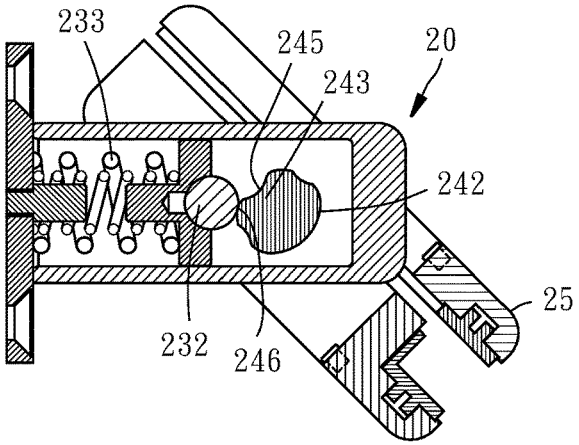

Referring to FIG. 8B and FIG. 9B, when the glass door A is opened by 45 degrees against its closed state, in the hydraulic hinge assembly 10, the tooth portion 143 engages with one of the rack 134, so that the guide wheel 142 guides the piston seat 131 to press the oil in the first oil storage area 125, making the oil flow to the second oil storage area 126 from the first oil storage area 125 through the routing mouth 138, the guide groove 133, and the routing channel 135. At the same time, in the leaf positioning assembly 20, the first ball 232 leaves the pit 245 at the front end 243 of the cam 242 and leans against the convex surface 246 of the cam 242.

Figure 8C:
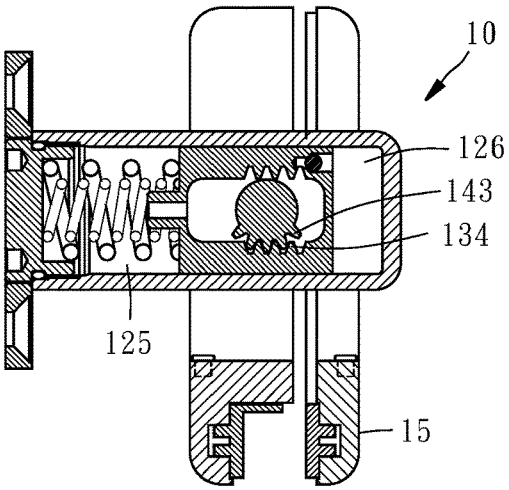
Figure 9C:
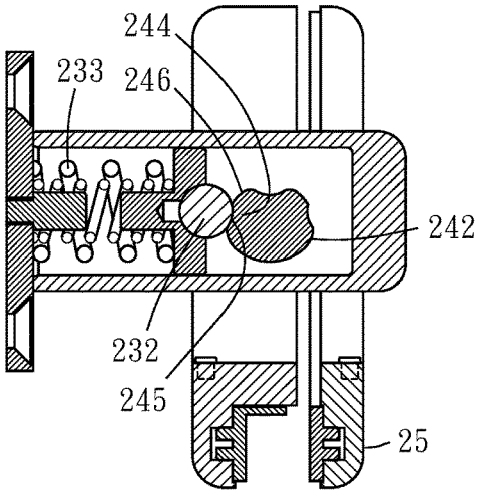

Then referring to FIG. 8C and FIG. 9C, when the glass door A is further opened by 90 degrees, in the hydraulic hinge assembly 10, the tooth portion 143 still engages with the rack 134, so the oil keeps flowing to the second oil storage area 126 from the first oil storage area 125 through the routing mouth 138, the guide groove 133, and the routing channel 135. Meanwhile, in the leaf positioning assembly 20, the first ball 232 leaves the convex surface 246 of the cam 242 and enters the pit 245 at one of the lateral ends 244 of the cam 242. At the same time, the second spring 233 makes the first ball 232 abut against the pit 245 at the lateral end 244 of the cam 242, so as to stop the second grip unit 25 and the first grip unit 15 from rotation. Thereby, the glass door A is positioned at its 90-degree open position and is prevented from returning to the closed state.

Similarly, for closing the door, by pushing the glass door A, the first ball 232 is made leave the pit 245 at the lateral end 244 of the cam 242 and leans against the convex surface 246 of the cam 242. At this time, the leaf positioning assembly 20 loses its positioning effect, and the first spring 132 in the hydraulic hinge assembly 10 returns the piston seat 131, while making the piston seat 131 drive the first shaft 141 to pivot, thereby driving the first grip unit 15, the second shaft 241, the second grip unit 25, and the glass door A to pivot. As a result, the piston seat 131 presses the oil in the second oil storage area 126 to make it flow to the first oil storage area 125 from the second oil storage area 126 through the oil passage 127 and the valve hole 128, until the piston seat 131 returns to its original position and returns the glass door A to its closed state. It is to be noted that, by adjusting the regulating valve 129 in the valve hole 128, the oil flow passing through the valve hole 128 and in turn the closing velocity of the glass door A can be set as desired.

Thereby, the automatic return device 1 for glass doors as disclosed in the present invention can advantageously control the closing velocity of a glass door A and positions the glass door A at its open position.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An automatic return device for glass doors, the device comprising:

a hydraulic hinge assembly, comprising:

a first fixing plate;

a first base, being fixedly connected to the first fixing plate and defining therein an oil storage area extending transversely and a first axial hole vertically communicated with the oil storage area;

a piston unit, having a piston seat that is received in the oil storage area in a transversely movable manner, wherein the piston seat has a guide groove that extends vertically and has two racks flanking the guide groove;

a first drive axle, having a first shaft and a guide wheel attached to the first shaft, the first shaft being rotatably received in the first axial hole and have two ends thereof exposed outside the first axial hole, the guide wheel being located in the guide groove of the piston seat, the guide wheel having a tooth portion for selectively engaging with the two racks, so that the piston seat is guided by the guide wheel and presses oil in the oil storage area;

a first grip unit, gripping a glass door and being connected to two ends of the first shaft so as to pivot with the first shaft synchronously; and a leaf positioning assembly, comprising:

a second fixing plate;

a second base, being fixedly connected to the second fixing plate and defining therein a transversely extending receiving area and a second axial hole vertically communicated with the receiving area;

a slide seat unit, comprises a slide seat, a first ball, and a first spring, wherein the slide seat is set in the receiving area in a transversely movable manner, and the first spring is set in the receiving area to abut against one end of the slide seat whose opposite end is provided with a depression for receiving the first ball;

a second drive axle, having a second shaft and a cam attached to the second shaft, the second shaft being rotatably received in the second axial hole and having two ends thereof exposed outside the second axial hole, the cam having a front end and two lateral ends connected to the front end, each of the front end and the two lateral ends having a pit for the first ball to selectively lean against one of the pits; and a second grip unit, gripping the glass door and being connected to two ends of the second shaft so as to pivot with the second shaft synchronously.

2. The automatic return device of claim 1, wherein the piston unit further comprises a second spring, and the piston seat divides the oil storage area into a first oil storage area and a second oil storage area, so that the second spring is set in the first oil storage area and abuts against the piston seat, in which the first base contains an oil passage, a valve hole, and a regulating valve, the oil passage communicating the first oil storage area with the second oil storage area, and the valve hole being communicated with the oil passage and receiving the regulating valve.

3. The automatic return device of claim 2, wherein the valve hole extends downward from a top of the first base and communicates with the oil passage.

4. The automatic return device of claim 2, wherein the piston seat defines therein a routing channel that are communicated with the second oil storage area and the guide groove.

5. The automatic return device of claim 4, wherein one of the racks has a through hole, and the routing channel is communicated with the guide groove through the through hole.

6. The automatic return device of claim 4, wherein the routing channel comprises a large-diameter segment and a small-diameter segment communicated with each other, the small-diameter segment being communicated with the guide groove, the large-diameter segment being communicated with the second oil storage area, a second ball being set in the large-diameter segment, and the second ball having an outer diameter that is greater than the a bore of the small-diameter segment.

7. The automatic return device of claim 1, wherein a first fixed bar passes transversely through the first grip unit and one end of the first shaft, and a second fixed bar passes transversely through the second grip unit and one end of the second shaft.

8. The automatic return device of claim 1, wherein the depression provided at the opposite end of the slide seat is hemispherical.

9. The automatic return device of claim 1, wherein the slide seat comprises a disk body and a column, the disk body having a front end surface, a rear end surface, and a circular lateral connected between the front end surface and the rear end surface, the circular lateral of the disk body abutting against an inner wall of the receiving area, the rear end surface of the disk body having the depression, the column one end being fixedly connected to the front end surface of the disk body, and the first spring abutting against the front end surface of the disk body and being mounted around the column.

10. The automatic return device of claim 1, wherein each of the pits extends vertically at the front end or one of the two lateral ends of the cam.

* * * * *